US006342136B1

(12) United States Patent
Virtanen et al.

(10) Patent No.: US 6,342,136 B1
(45) Date of Patent: Jan. 29, 2002

(54) BUSBAR CONSTRUCTION FOR ELECTROLYTIC CELL

(75) Inventors: Henri Virtanen; Ismo Virtanen, both of Pori; Tuomo Kivistö ; Tom Marttila, both of Kirkkonummi, all of (FI)

(73) Assignee: Outokumpu Oyj, Espoo (FI)

( * ) Notice: Subject to any disclaimer, the term of this patent is extended or adjusted under 35 U.S.C. 154(b) by 0 days.

(21) Appl. No.: 09/674,124

(22) PCT Filed: Apr. 21, 1999

(86) PCT No.: PCT/FI99/00324

§ 371 Date: Dec. 26, 2000

§ 102(e) Date: Dec. 26, 2000

(87) PCT Pub. No.: WO99/57337

PCT Pub. Date: Nov. 11, 1999

(30) Foreign Application Priority Data

May 6, 1998 (FI) ..... 980999

(51) Int. Cl.[7] ..... C25B 9/02

(52) U.S. Cl. ..... 204/242; 204/267; 204/286.1; 204/288; 204/279; 204/297.01

(58) Field of Search ..... 204/242, 267, 204/286.1, 288, 297.01, 279

(56) References Cited

U.S. PATENT DOCUMENTS

| | | | | |
|---|---|---|---|---|
| 3,682,809 A | | 8/1972 | Marquadrson et al. | 204/275 |
| 3,697,404 A | | 10/1972 | Paige | 204/267 |
| 3,929,614 A | | 12/1975 | Hidohira | 204/242 |
| 4,035,280 A | | 7/1977 | Deane et al. | 204/267 |
| 6,045,669 A | * | 4/2000 | Matsumoto et al. | 204/297.01 |

* cited by examiner

*Primary Examiner*—Bruce F. Bell

(57) ABSTRACT

This invention applies to an electrolytic cell busbar construction for the purpose of the electrolytic recovery of metals. The construction is formed so that the gap between the electrodes can be changed easily. All parts of the construction are in the form of an integral profile longitudinally to the cell and the support lugs of the electrodes in the cell are unnotched.

11 Claims, 2 Drawing Sheets

BUSBAR CONSTRUCTION FOR ELECTROLYTIC CELL

BACKGROUND OF THE INVENTION

This invention focuses on the electrolytic cell busbar construction meant for the electrolytic recovery of metals, shaped as a whole so that the gap between the electrodes, i.e. spacing, can be chosen and changed freely. All the parts of the construction have constant cross sections lengthwise in the cell.

In tankhouses designed for the electrolytic recovery of metals such as copper, nickel and zinc, typically there are a large number of electrolytic cells which are series connected in groups so that the anode in one cell is connected electrically to the cathode in the next cell by highly conductive busbars, generally made of copper, which are on the partition wall between the tanks. This arrangement is known as the Walker system.

The construction normally also includes a notched insulating bar, which comes on top of the busbar to separate the cathode in the preceding cell and the anode in the following cell from the busbar. This arrangement is necessary because all the electrodes in the tanks would otherwise be electrically together and current would not then flow through the electrolyte.

In the busbar of the prior art, the side walls usually feature bulges that are semicircular or triangular by cross section and lengthwise along the busbar, and bulges are either continuous or, for the insulating busbar, broken. The electrodes to be in contact with the busbar are lowered on top of these bulges. The idea of the bulges is firstly to stiffen the busbar and secondly to form a linear contact between the bar and the electrode.

The insulating bar has brackets pointing sideways, which come either between the broken bulges of the busbar or on top of the continuous ones. The electrodes which will not come into contact with the busbar are lowered on top of these insulating brackets.

Known before is also a busbar arrangement presented is U.S. Pat. No. 3,682,809 in FIG. 1 thereof, in which the busbar is continuous, but the electrodes' support lugs are notched on the side where they will be placed on top of the busbar. According to the figure, the support members of the same electrode vary in length. The figure does not show, however, how the electrodes of two adjacent tanks are located in relation to the busbar and insulating bar.

With a conventional busbar construction and with notched electrodes, the following disadvantages are always present:

- The electrical connection of each electrode to the circuit is based on a single contact. Since the quality of the contact (good/bad contact) varies greatly, the distribution of current between the electrodes is uneven.
- If a notched copper bar is used, its manufacturing costs are greater than for an unnotched one. If in turn an unnotched busbar is used, the electrodes will not be in horizontal position due to the insulating busbar.
- The manufacture of notched electrodes is more expensive than that of unnotched.
- When brought to the cell, the notched electrodes must be lowered into the cell widthwise very carefully to be in the correct position in relation to the busbar.
- Due to the notched insulating bar and the possibly copper busbar, the electrodes must be lowered into the cell very carefully to be in the right position lengthwise in relation to the busbar, so that the electrical contacts and separations are generated correctly. The thermal elongation of the busbar may cause problems.
- A notched busbar does not allow the changing of the gap between electrodes without replacing all the busbars and insulating bars. Altering the gap between electrodes with an unnotched copper busbar requires the replacement of the insulating bars.
- Due to the notched insulating bar, the cleaning of the busbars in practice always requires the removal of the insulating bar during cleaning. This makes mechanized cleaning in particular considerably more difficult.
- Since notched busbar has to be made relatively thin, it is generally rather weak and short-lived.

SUMMARY OF THE INVENTION

The purpose of the invention developed here is to achieve a busbar construction which will avoid the aforementioned drawbacks of the conventional construction. In the busbar construction as per the invention, a highly electroconductive main busbar is set on top of the side wall of the electrolytic cell, connecting the anodes of the previous cell to the cathodes of the adjacent cell electrically so that the tanks are connected in series in the usual way. The main busbar has continuous side bulges with different heights so that one set of electrodes—anodes or cathodes—are lower down in the cell than the other. Support elements are also fitted on top of the side wall of the electrolytic cell and these support the electrodes on the side which is not in contact with the main busbar. The support elements are electrically insulated from the main busbar and profitably they are of electrically conductive material so that they balance the potential between the electrodes of the same sign in the cell. The main busbar, support elements and insulating materials are all integral longitudinally to the cell, with constant cross sections throughout their entire lengths. The essential features of the invention are apparent in the enclosed patent claims.

The lateral bulges of the main busbar are at different heights so that some electrodes, for example the anodes, are slightly lower down in the cell than other electrodes, i.e. in this case the cathodes. In practice, both the lower bulge of the main busbar on one side of the cell and the lower support element on the other side of the cell are closer to the center line of the cell than the higher ones, whence the support lugs of the electrodes situated lower are made shorter than those of the electrodes situated upper, and the upper bulge and support element are located near the center line of the cell wall, bringing them further away from the center line of the cell itself than the lower ones. If necessary this can be done in the opposite way i.e. to locate the cathodes on the lower bulges and the anodes on the upper ones. The bulges of the main busbar are continuous and have no insulating brackets on them. The terms continuous or integral are used to mean that the material is not notched for the placement of the electrodes and that the material is essentially of equal strength along the length of the cell. The electrode support lugs are also unnotched.

The support element of the upper electrodes is placed on top of the main busbar between its bulges. The support element is most advantageously a potential balancing bar, separated from the main busbar by insulating material. Both the bar and the insulating material have constant cross sections along their lengths. This bar is at the same level as the upper bulge of the main busbar and forms an electrical connection between the support lugs of the upper electrodes which are not on a main busbar.

The lower electrodes support element, which is also preferably a potential balancing bar, is placed on the outside of the main busbar, next to its upper bulge along the edge of the cell and on top of the insulating material. Both the bar and the insulating material have constant cross sections along their lengths. This bar is at the same level as the lower bulge of the main busbar and forms an electrical connection between the support lugs of the lower electrodes which are not on a main busbar. The insulation below this potential balancing bar may be integrated into that between the main busbar and the side wall of the cell.

Compared with the prior art, the busbar solution presented in the invention offers at least the following advantages:

- Both the main busbar and potential balancing bars, as well as the insulating profiles, are unnotched with constant cross sections, whereby the distribution of electrodes can be changed freely without needing to touch the busbar.
- Mechanical cleaning of the busbars is simple, since all surfaces to be cleaned are continuous and of one material. The busbar construction need not be dismantled for cleaning.
- The busbar construction is sturdy and long-lasting.
- Due to the potential balancing bar, each electrode is now equipped with two contacts to the electric circuit: if one electrode has a contact to the main busbar which is worse than average, the electrodes in parallel even out the current distribution through the potential balancing bar to obtain a more even current distribution.
- The electrodes can always be made straight.
- The electric contacts and separators are always generated correctly, even if the electrodes are not lowered into the tanks carefully into the correct place laterally and longitudinally in relation to the busbar. The thermal extension of the busbar presents no problems.

BRIEF DESCRIPTION OF THE DRAWINGS

The invention is illustrated more accurate in the accompanying figures in which.

DETAILED DESCRIPTION OF THE INVENTION

Figure 1:
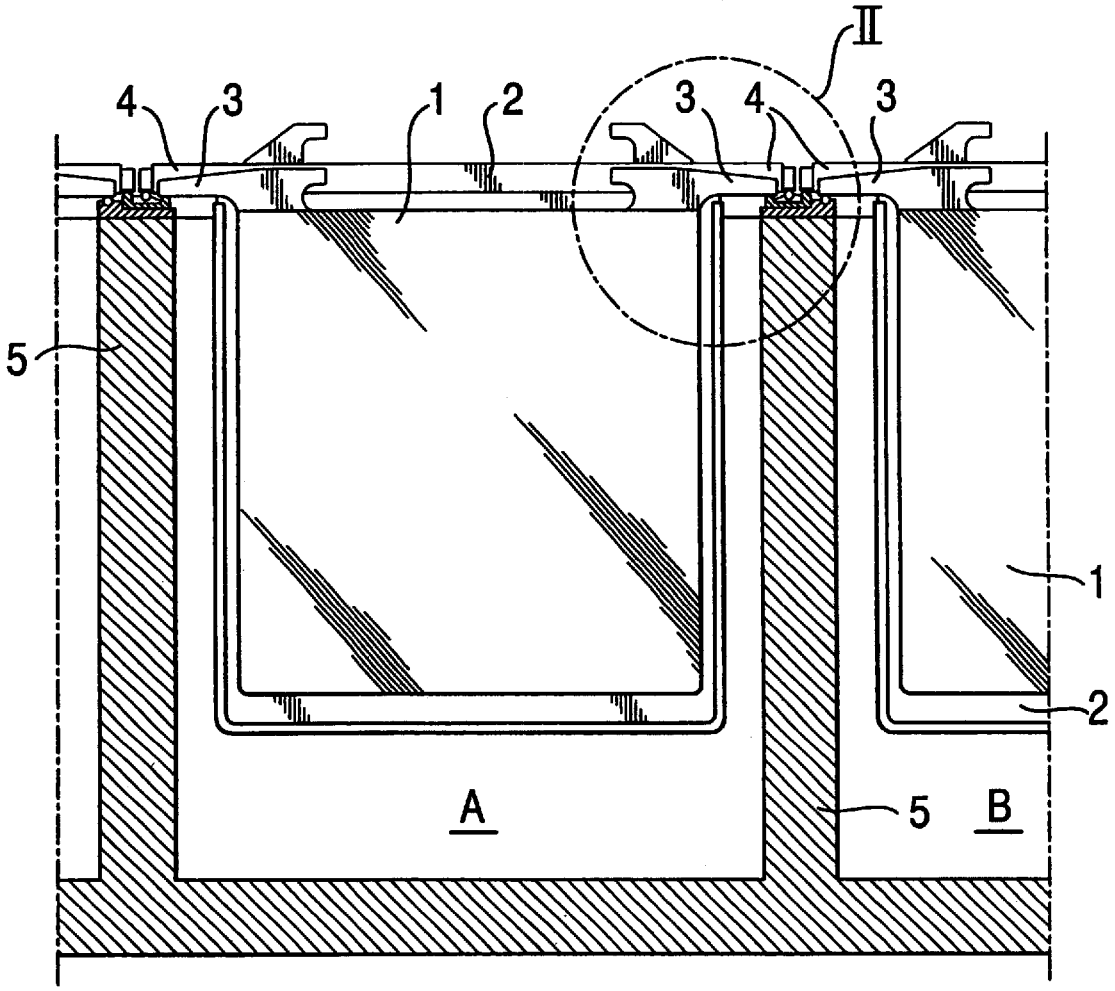
FIG. 1 is a cross section of an electrolytic cell with the busbar construction according to the invention.

According to FIG. 1, anodes and cathodes have been lowered into electrolytic cell A, and likewise into cell B, with only their support lugs visible in the figure. As in the figure, anode 1, in the foreground, is placed lower down than cathode 2 which is in the background. As is generally the case, the anodes and cathodes are placed in the cell alternately. Both anodes and cathodes are supported by support lugs 3 and 4 to the busbar construction of this invention placed on electrolytic cell side walls 5. With side wall is meant the side wall between two adjacent tanks, whether it is formed of one or more adjacent parts.

Figure 2:
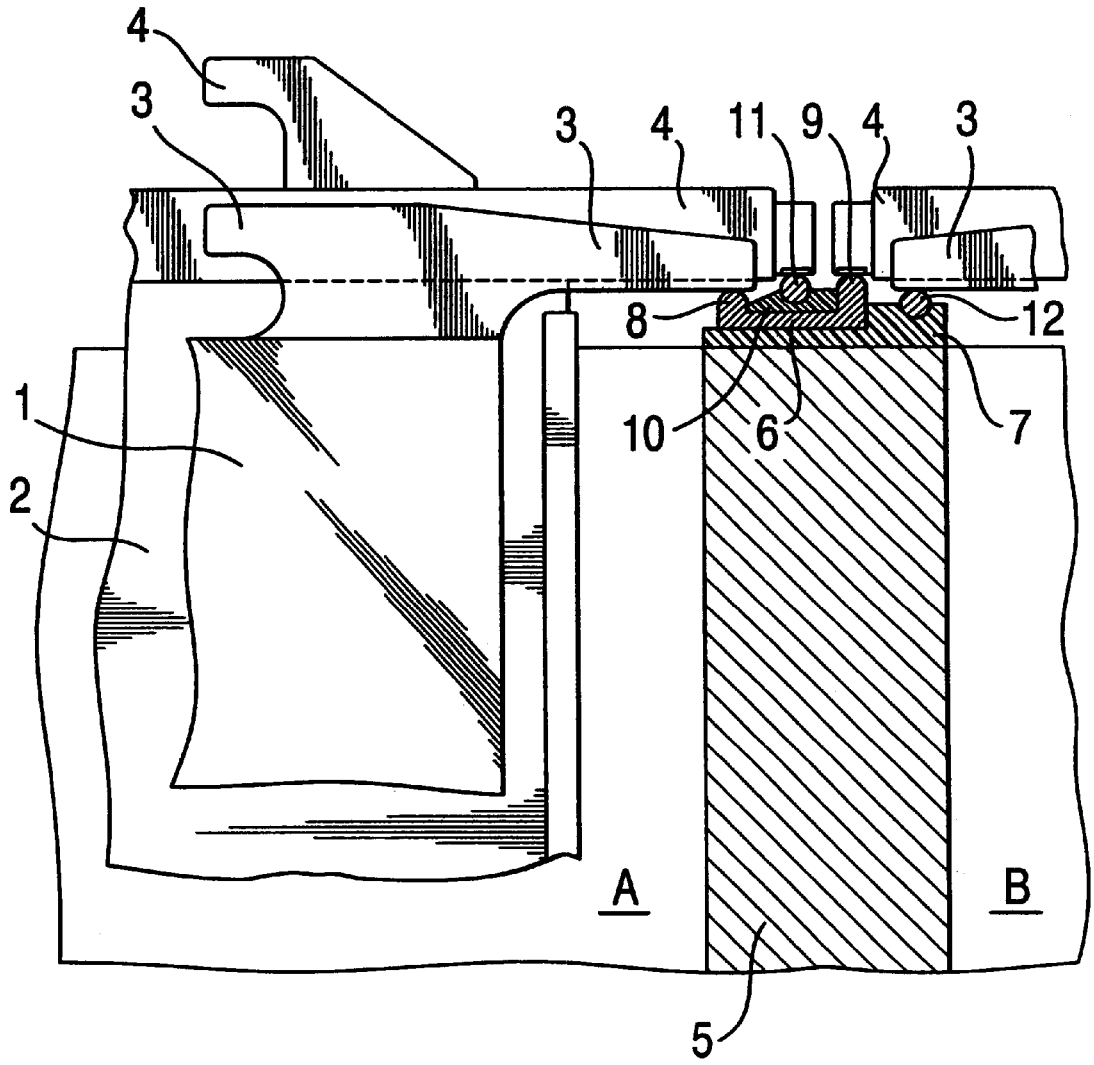
FIG. 2 shows a more detailed view of the busbar construction.

FIG. 2 shows more accurately how main busbar 6 is placed on top of insulating plate 7 which is on side wall 5. The use of an insulating plate under the main busbar is not essential, but is recommended for practical considerations. The main busbar extends on the top of the side walls right along the length of the cell. The lower surface of the main busbar is horizontal and as may also be the center of the upper surface, but at the edges of the bar, two continuous bulges or ridges of different heights rise to project upwards longitudinally. The bulges may be differently shaped, but for example a bulge of semicircular cross section is suitable. In the case of FIG. 2, the support lugs 3 of the anodes in cell A are placed on the lower bulge 8 and the support lugs 4 of the cathodes in cell B are on top of the higher bulge 9. Instead of being notched, the lower edge of the electrodes' support lugs is continuous. A suitable difference in height for the bulges is usually 5–15 mm, and for practical reasons, anodes are often selected to be the lower electrodes. It is expedient to place the lower bulge closer to the edge of the cell and the upper bulge in the vicinity of the center of the side wall.

A continuous insulating profile 10 is placed between the bulges 8 and 9 of the main busbar 6 along the whole length of the busbar, and on top of the profile a support element 11 of the cathodes of cell A, which support element in this case is an electrically conductive potential balancing bar. Since the support lugs of the cathodes in the other side of the cell A (not shown in the figure) is supported on the upper bulge of the main busbar in the next cell, the upper part of the potential balancing bar 11 is fitted at the same height as the upper bulge of the main busbar, so that the cathodes are horizontal on their support lugs 4.

As can also be seen in FIG. 2, the main busbar 6 does not extend along the whole width of the cell edge, but part of the edge is covered only by the insulation plate 7. A support element 12 of the anodes in cell B, in this case also a potential balancing bar, is most advantageously placed on the part of the insulation plate which is outside the main busbar and in this way, the support element connects the anode support lugs which are not supported by the main busbar. This support element is set at such a height that it raises support lugs 3 of the other end of the anodes to the same height as those on the main busbar. There is no insulating material on either potential balancing bars. The bars are preferably made of a single material, e.g. a round or triangular rod by cross section.

If, in regard to either of the electrodes, anodes or cathodes, it is not wished to use a potential balancing bar as support element, the bar can be replaced by a correspondingly made profile of insulating material or to shape the insulating material directly so that it will bear the support lugs of the electrodes at the correct height. In this case however, some of the aforementioned advantages will be lost.

As previously stated, the main busbar does not extend across the whole width of the side walls of the cell, but is somewhat more than half of the width of the side wall. It is best to set both of the electrode support elements at, an approximately equal distance from the center line of the side wall as the corresponding bulge of the main busbar.

What is claimed is:

1. An electrolytic cell busbar construction of series connection type, designed for the electrolytic recovering of metals, wherein the busbar construction is situated on top of the each side wall (5) of the cell, characterized in that the main busbar (6) of the cell is provided with continuous bulges (8,9) longitudinal to the cell, and which bulges are of different heights in order to support the unnotched support lugs (4) of anodes in one cell on one bulge and the unnotched support lugs (3) of cathodes of the adjacent cell on the other bulge; the busbar construction is equipped with insulated, continuous support elements (11,12) longitudinally to the cell and insulated from the main busbar in order to bear the ends of the support lugs of the electrodes which are not on a main busbar at the same level as the end of the corresponding electrode supported on a main busbar.

2. A busbar construction according to claim 1, characterized in that a continuous insulation profile (10) is placed between the bulges (8,9) of the main busbar (6).

3. A busbar construction according to claim 2, characterized in that one support element (11) of the electrodes is placed on top of the insulation profile (10) which is between the bulges (8,9) of the main busbar (6), and wherein the support element (11) is essentially at the same level as the upper bulge (9) of the main busbar.

4. A busbar construction according to claim 1, characterized in that the main busbar extends only over part of the width of the cell side wall (5).

5. A busbar construction according to claim 4, characterized in that the other of the electrode support elements (12) is located outside the main busbar (6) on top of the insulating material (7), and the support element (12) is essentially at the same level as the lower bulge (8) of the main busbar.

6. A busbar construction according to claim 1, characterized in that at least part of the width of the side wall is covered with a continuous insulation material (7).

7. A busbar construction according to claim 1, characterized in that the continuous insulation material (7) is placed on the side wall of the cell (5) and the main busbar is placed on top of that.

8. A busbar construction according to claim 1, characterized in that the support elements (11,12) are potential balancing bars made of electrically conducting material.

9. A busbar construction according to claim 1, characterized in that support elements (11,12) are made of insulating material.

10. A busbar construction according to claim 1, characterized in that the lower bulge (8) of the main busbar and the support element (12) positioned at the same level are located close to the edge of the cell wall.

11. A busbar construction according to claim 1, characterized in that the main busbar bulges and the support elements positioned at the same level are located approximately at the same distance from the center of the side wall.

* * * * *